US006393721B1

(12) United States Patent
Sunde

(10) Patent No.: US 6,393,721 B1
(45) Date of Patent: May 28, 2002

(54) DRYING APPARATUS

(75) Inventor: Trond Sunde, Ålesund (NO)

(73) Assignee: Articare AS, Stomarknes (NO)

( * ) Notice: Subject to any disclaimer, the term of this patent is extended or adjusted under 35 U.S.C. 154(b) by 0 days.

(21) Appl. No.: 09/673,821

(22) PCT Filed: Feb. 25, 1999

(86) PCT No.: PCT/NO99/00061

§ 371 (c)(1),
(2), (4) Date: Dec. 21, 2000

(87) PCT Pub. No.: WO99/57500

PCT Pub. Date: Nov. 11, 1999

(30) Foreign Application Priority Data

Apr. 23, 1998 (NO) ..... 981835

(51) Int. Cl.[7] ..... F26B 17/12
(52) U.S. Cl. ..... 34/168; 34/236; 34/594
(58) Field of Search ..... 34/583, 594, 147, 34/183, 189, 236, 168

(56) References Cited

U.S. PATENT DOCUMENTS 3,789,513 A * 2/1974 Mark ..... 34/10
3,871,111 A 3/1975 Porr
4,126,947 A * 11/1978 Labouygues ..... 34/69
4,130,944 A * 12/1978 Hultsch et al. ..... 34/8
4,479,920 A * 10/1984 Dodson ..... 422/143
4,499,669 A * 2/1985 Haeck ..... 34/102
5,709,036 A * 1/1998 Haleen ..... 34/179

FOREIGN PATENT DOCUMENTS

| | | |
|---|---|---|
| DE | 2 239 098 | 2/1974 |
| DE | 38 19 945 C2 | 12/1989 |
| EP | 696 715 B1 | 2/1996 |
| GB | 2019994 | 11/1979 |

* cited by examiner

*Primary Examiner*—William Doerrler
*Assistant Examiner*—Melvin Jones
(74) *Attorney, Agent, or Firm*—Browdy and Neimark

(57) ABSTRACT

A device which is employed in drying of particulate, granular or powdered material, substantially fish-related material. The device has a drying chamber designed substantially as a vertical standing container. The drying chamber may be circular cylindrical and has a conically shaped tapering shape over its entire or parts of its height. The conically tapering shape may be directed towards the drying chamber's upper or lower portion. The material may be inserted in the bottom area or in the top of the standing container (1), through an inlet (5). In the drying chamber's bottom area there is placed a movement device (3) which sets the material in the drying chamber in rotary motion, thereby flinging the material towards the drying chamber's vertical wall, which is heated by means of a heating jacket (2).

10 Claims, 4 Drawing Sheets

5
10
8
10
7
2
0.5
1
6
3
4

DRYING APPARATUS

CROSS REFERENCE TO RELATED APPLICATION

The present application is the national stage under 35 U.S.C. 371 of PCT/NO99/00061, filed Feb. 25, 1999.

BACKGROUND OF THE INVENTION

Technical Field of the Invention

The present invention relates to a device for use in drying materials, especially particulate, granular or powdered materials, but also materials in liquid form, in a drying chamber in which the material is set in motion. An embodiment of the invention has been developed especially for handling of fish-related products such as crushed fish offal as well as chemical residues and waste products, but the inventive concept may be applied to practically all types of material with similar consistency and drying requirements.

OBJECT AND SUMMARY OF THE INVENTION

In drying of materials of the above-mentioned types, extensive use is made of rotating, horizontally located drums which are heated, or the material is placed in a drying chamber, where it is whirled round in a warm environment in order to effect drying. These drying devices may provide satisfactory drying, but the degree of dryness achieved for the material being treated can often be uneven, and it can be difficult to achieve the exact drying effect desired without the use of sophisticated aids.

In patent publication EP-A2-0 696 715, moreover, the use is disclosed of a circular cylindrical drying chamber with vertical straight walls and a movement device in the bottom. The material moves up in the chamber as it dries and can be removed from the top portion of the chamber.

DE 3819945 describes a drying device for drying particulate, granular or powdered material, comprising a drying chamber (1) with means for moving the material and means for heating the material, whereby the drying chamber (1) is conically tapering over its entire, or parts of its height. The device further has a movement device and a heating jacket. The material to be dried is however constantly supplied with a gas (preferably heated) through the outlet (9) in the rotational axle (7), which also rotates the movement device (8). The added air is then ventilated off at the top.

DE 2239098 further describes a drying chamber where the substance to be dried is constantly ventilated with ambient air or other gas.

This is also the case with the drying apparatus in GB 2019994 where the products to be dried moves in a downward direction and added gas moves in the upward direction, and the gas and the substance to be dried is constantly mixed in the drying chamber, The chamber is also fitted with an external heating jacket.

On the basis of previously known solutions as mentioned above, according to the present invention a device has been provided where the drying chamber is conically taperingly formed towards the drying chamber's upper or lower portion, thus enabling a further favourable movement to be achieved in the partially dried and gradually almost completely dried material in comparison with a drying chamber with straight vertical walls.

If the drying chamber is conically tapering towards the drying chamber's upper portion the incompletely dried material which rises in the chamber will be able to be moved towards the chamber's centrally located area and fall down there. This in turn will lead to an accumulation of incompletely dried material in the centrally located area in the chamber's lower part and this material undergoes a new movement along the drying chamber's walls. In a design of this kind only the material which attains the desired degree of dryness will be permitted to be discharged and this can be controlled according to requirements. The design is suitable, amongst other things, for drying individual batches of material (batch drying).

If the drying chamber is conically tapering towards the drying chamber's lower portion, the gradually dried material will be able to move along the walls in the drying chamber towards the drying chamber's upper portion. This is further facilitated by the fact that the drying chamber is conically taperingly formed towards the drying chamber's lower portion. The material which has not yet attained the desired degree of dryness is prevented from moving towards the centrally located area of the chamber to fall down there and lie in the area at the bottom of the drying device. This design is therefore well suited for a continuous process where the material is constantly ejected when it attains the desired degree of dryness. In addition it is possible with this design to achieve a uniform or almost uniform thickness of the layer of material which abuts against the drying chamber's walls.

The object of the present invention is to provide a device which offers a simple drying process, while at the same time the efficiency of the drying is easily controllable, and where an identical degree of dryness is ensured for the entire quantity of material.

According to the invention the device is further designed in such a manner that it can be adapted to suit the material which is inserted, the drying chamber being conically tapering over its entire height or parts of its height towards the top or the bottom of the drying chamber.

According to the invention a device is provided where in a preferred embodiment a vertically standing, preferably circular cylindrical container is employed as drying chamber. The drying chamber preferably has a conically tapering form either towards the drying chamber's upper or lower portion depending on which material has to be dried and whether this has to be undertaken in a continuous process or a batch process. The degree of tapering may be relatively small, between 0.1 and 10 degrees and generally round 0.5 degrees relative to the vertical plane in the chamber.

The device is provided with heating of the conical walls, at least over a substantial part of the wall surface, together with a movement device which flings the material against these heated walls. As the material is heated and dried, the material will become lighter, thereby being forced upwards in the vertical container towards an outlet in the top area. When setting the force from the movement device the dwell time in the cylinder can be set and coordinated with heating of the walls, with the result that when it reaches the outlet the material has the desired degree of dryness. The material can be fed continuously into the drying chamber in the bottom area by the movement device, which may, e.g., be a screw, and as it is dried may be permitted to continuously flow out in the top area. It will also be possible to feed in a specific quantity of material which is then set in rotary motion and when the material has reached the desired degree of dryness the chamber is emptied. It may further be advantageous for some types of material to perform this drying process without the presence of air in the drying chamber and for this purpose the chamber may be equipped with an end piece in order to provide an underpressure in the interior of the drying chamber.

The material may be inserted through a slanting inlet where the force of gravity forces the material into the drying container or it may be fed in by a driven feeding device. The insertion is performed in an embodiment in the lower portion of the walls in the drying device. In an embodiment the inlet to the device's drying chamber will be provided with a valve body which controls the introduction of material which has to be dried. Moreover, in a further embodiment a feed is provided in the drying device's upper part and this may be installed in the lid of the device. The feed in both the upper and lower portions may be used with a conical shape tapering both towards the upper and lower portions.

The invention can be used for drying of practically any material which can be caused to circulate in a container. However, the invention is especially intended for materials such as fish-related products, for example crushed fish offal, chemical residues and waste products, preferably in particulate form, but also in almost liquid form. After drying such products can be transported at a more reasonable price, since they are lighter in weight and easier to handle.

BRIEF DESCRIPTION OF THE DRAWINGS

The invention will now be described in more detail by means of different embodiments which are illustrated in the attached drawings, in which.

DETAILED DESCRIPTION OF THE PREFERRED EMBODIMENT OF THE INVENTION

Figure 1:
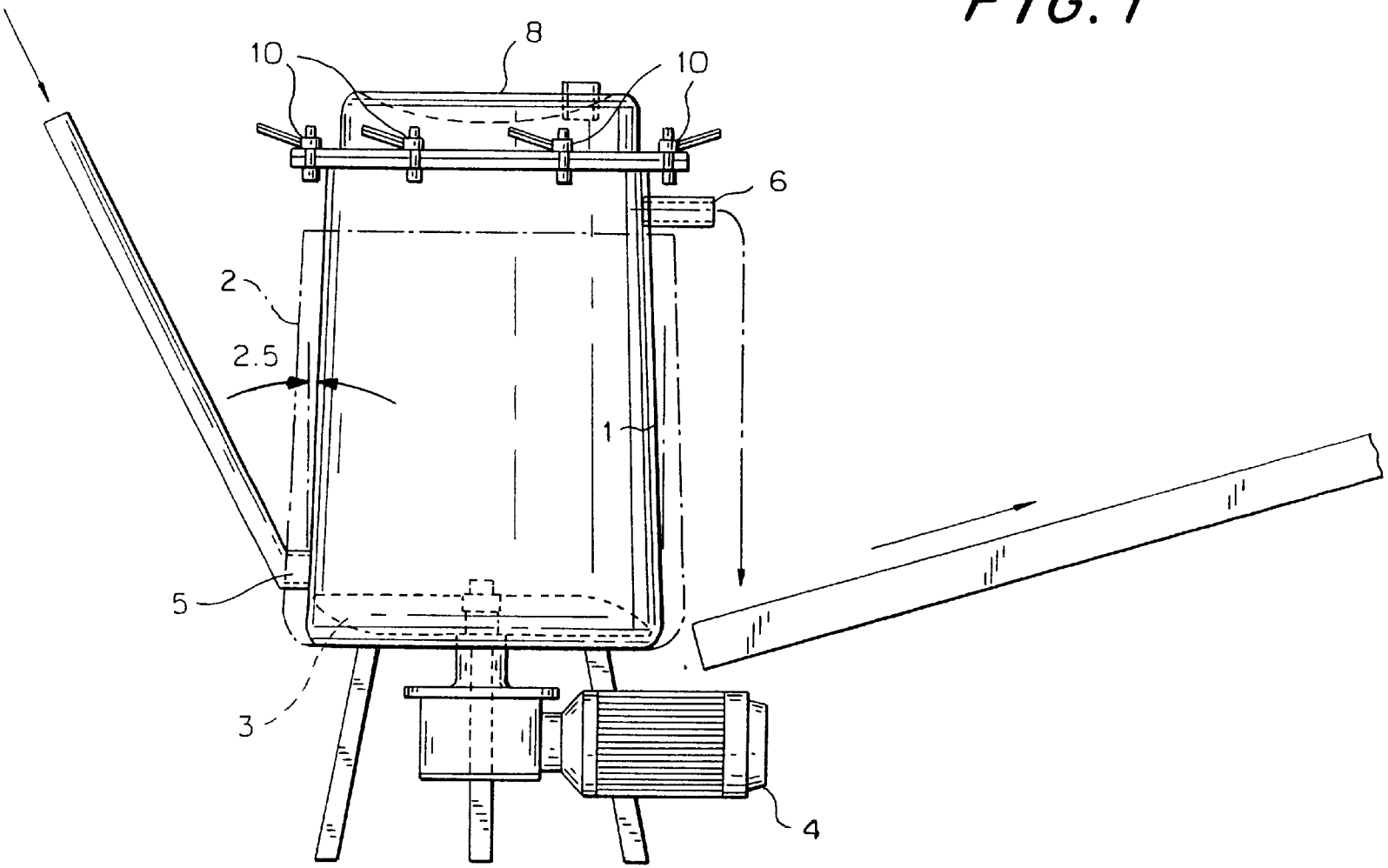
FIG. 1 illustrates schematically in partial section a device according to the invention where the drying chamber is conically tapering towards the drying chamber's upper portion and where the material is fed into the lower portion.
Figure 4:
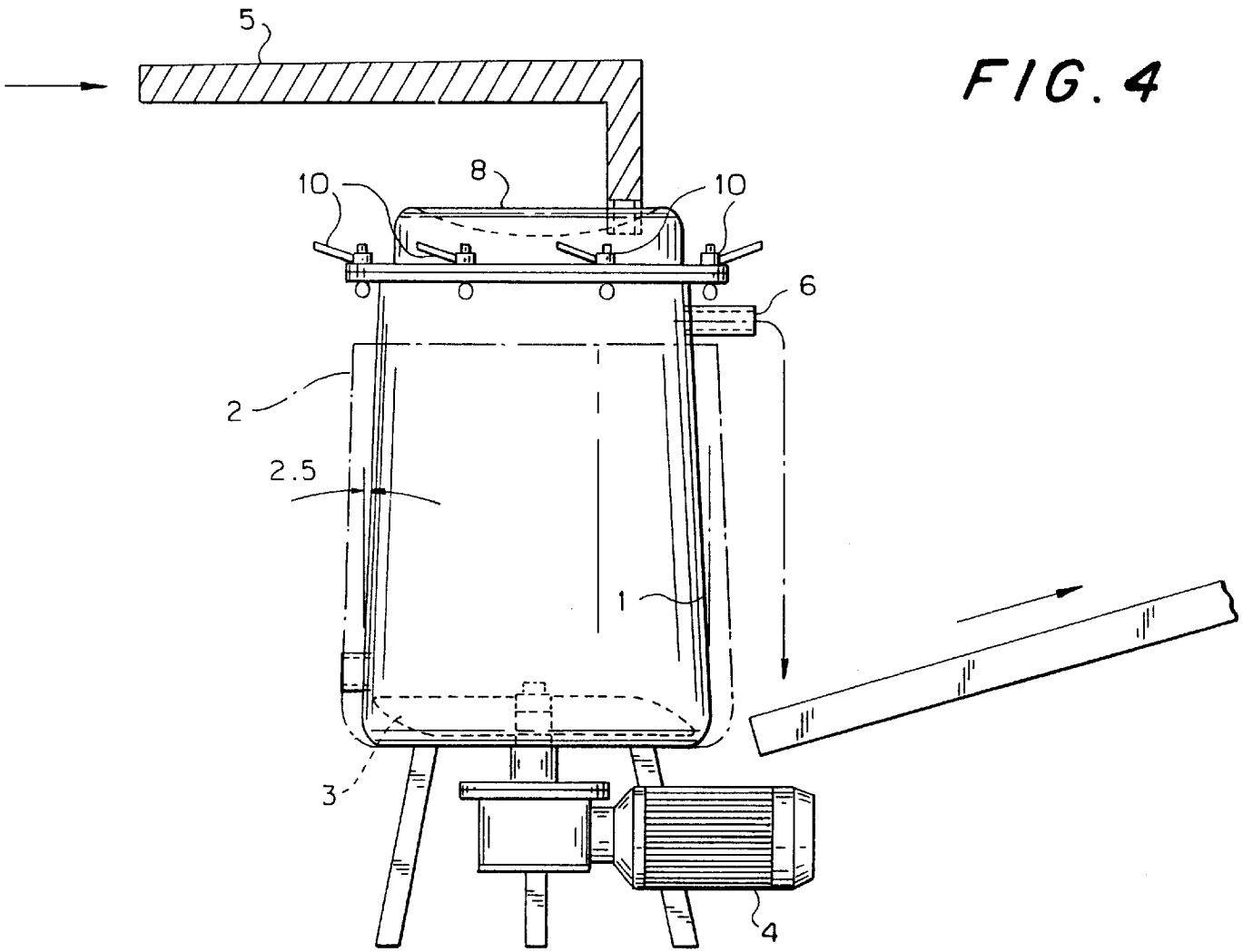
FIG. 4 illustrates schematically in partial section a device according to the invention where the drying chamber is conically tapering towards the drying chamber's upper portion and where the material is fed into the upper portion.

The device according to the invention, as illustrated in FIGS. 1 and 4 illustrates the device mounted on a stand, with a drying chamber in the form of a circular cylindrical container 1. In the embodiment illustrated in FIGS. 1 and 4 the drying chamber is slightly conically tapering towards the upper portion of the drying chamber, e.g. at an angle between 0.1 and 10 degrees, especially around 0.5 degrees.

Figure 2:
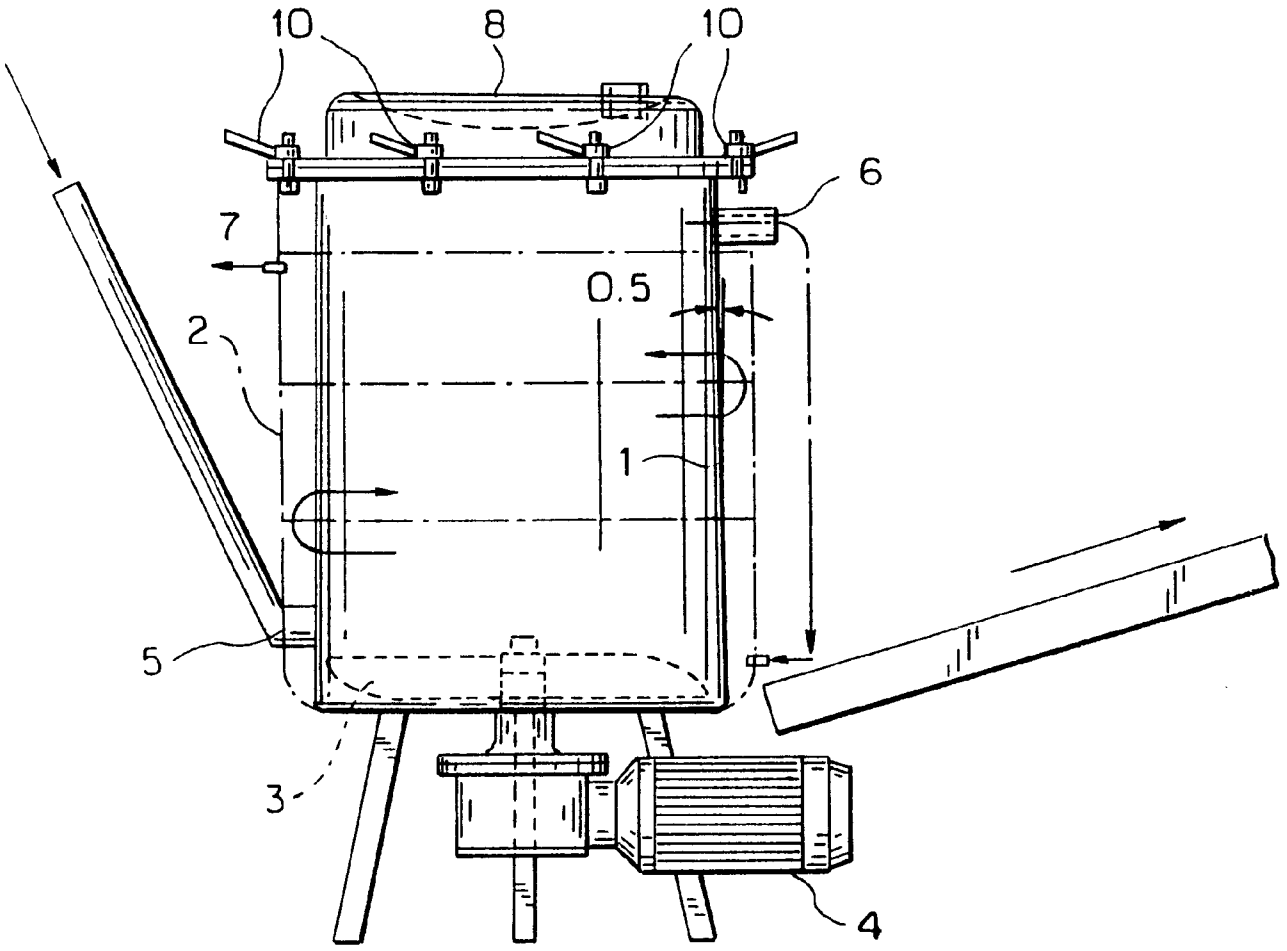
FIG. 2 illustrates schematically in partial section a device according to the invention where the drying chamber is conically tapering towards the drying chamber's lower portion and where the material is fed into the lower portion.
Figure 3:
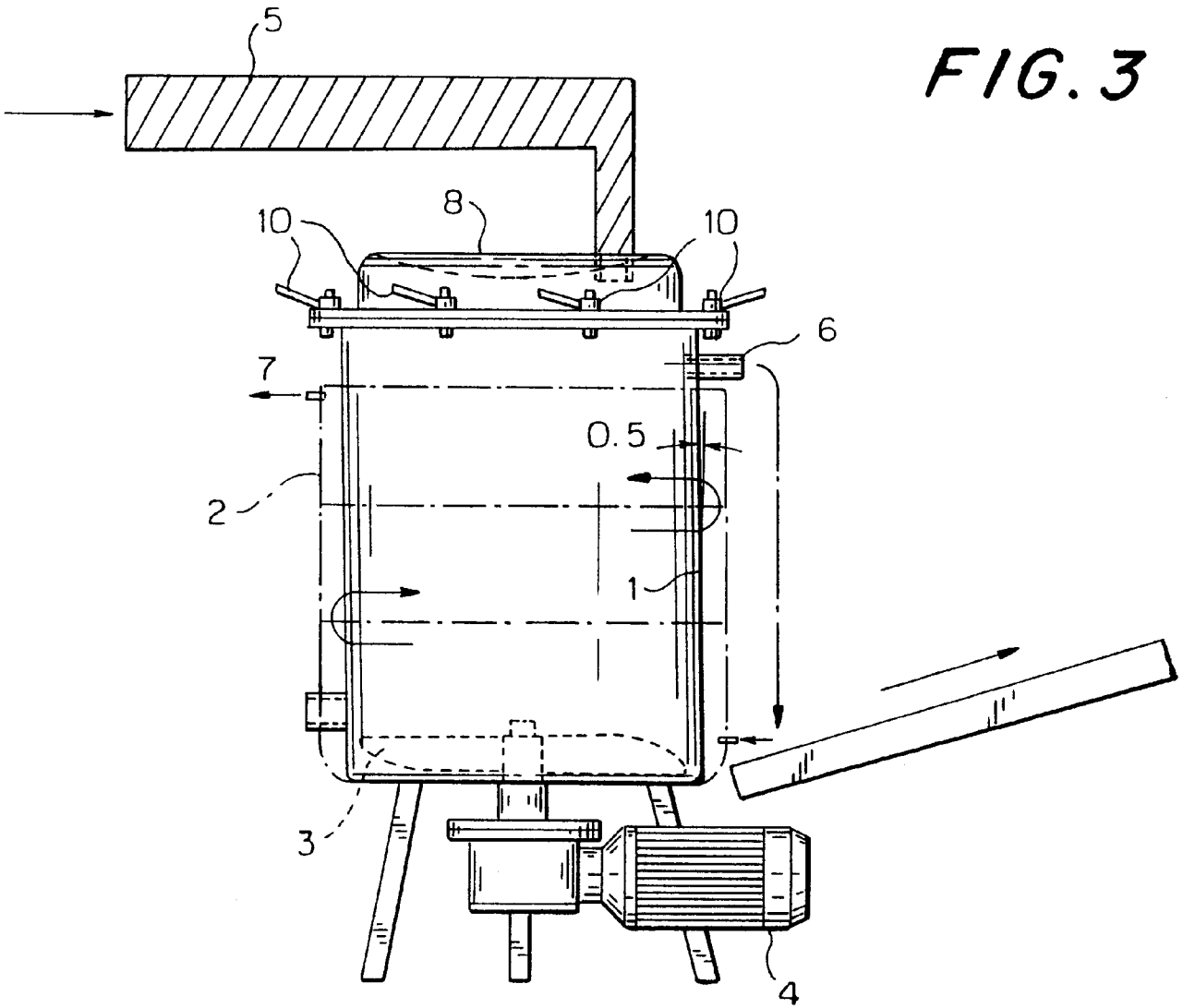
FIG. 3 illustrates schematically in partial section a device according to the invention where the drying chamber is conically tapering towards the drying chamber's lower portion and where the material is fed into the upper portion.

The device according to the invention, as illustrated in FIGS. 2 and 3 illustrates the device mounted on a stand, with a drying chamber in the form of a circular cylindrical container 1. In the embodiment illustrated in FIGS. 2 and 3 the drying chamber is slightly conically tapering towards the lower portion of the drying chamber, e.g. at an angle between 0.1 and 10 degrees, especially around 0.5 degrees.

The drying chamber may also have a different circumferential shape. In certain cases the use of an angular chamber may be envisaged, even though a circular cylindrical chamber is to be preferred.

Round the lower part of the drying chamber in FIGS. 1–4 there is placed a heating jacket 2, in which there may be installed a heating medium, which may be the supply of steam, heated oil or simply the installation of electrical heating elements. This jacket preferably envelops only the lower part of the drying chamber, e.g. a half to two thirds of the height of the drying chamber. The external form of the jacket need not be identical with the form of the inside of the drying chamber. For example, the jacket may be in the form of a straight-walled container.

In the example illustrated in FIGS. 1 to 4 there is provided in the drying chamber's bottom area a movement device in the form of a screw 3 which is arranged in the drying chamber's centre line and driven by a motor 4 outside the drying chamber. In FIGS. 1 and 2 there is illustrated in the drying chamber's lower area an inlet end piece 5 for the material which has to be dried. In FIGS. 3 and 4 the insertion is illustrated of the material which has to be dried through feed channel 5 to the drying chamber's upper portion or lid. In FIGS. 1 to 4 an outlet end piece is illustrated at the top of the drying chamber for discharge of the dried material. This end piece is indicated by 6. In FIGS. 2 and 3 there is also provided in the drying chamber's upper area an end piece 7 for connecting an underpressure hose if an underpressure requires to be established in the drying chamber.

In the illustrated examples the drying chamber's top 8 is removable and can be mounted on the drying chamber via a flange which is attached by tightening screws 10. The drying chamber's top may be designed with a depression in the centre area for guiding the dried material towards the outlet end piece 6. In the case of large containers a removable lid may be impractical and in order to gain access to the interior of the drying chamber, there may be employed, e.g., a manhole with a lid mounted at an arbitrary location, in order to permit cleaning and maintenance of the drying chamber.

During use the material will be fed into the drying chamber through the inlet 5. The screw 3 is set in rotary motion, thereby flinging the material against the drying chamber's side wall, where the material will gradually be dried due to its contact with the heated vertical lateral surface. As the material dries, it will become lighter, thereby being forced by the underlying material in the direction upwards in the drying chamber. After having reached a desired degree of dryness the material in a continuous drying process will be located at the top of the drying chamber, where it will flow out through the opening 6. In a batch process the drying chamber is opened when the desired degree of dryness has been achieved and the chamber is emptied. In the drying chamber there may further be provided suitable, not shown, probes for registering the material's degree of dryness, or this may be measured in the outlet area at the end piece 6. The result of this measurement can be used for adjusting the rotation speed and the temperature, thus achieving a desired degree of dryness. In addition, setting parameters can be established based on empirical data for different materials, and possibly materials with a predetermined degree of humidity, thus enabling a combination of temperature and rotation speed to be set which is suited to the special purpose.

In the illustrated examples a screw is used to set the quantity of material in rotation. It is also possible to perform the feeding in tangentially, by means of one or more slightly upwardly directed nozzles, which by means of pressure feed in the material with the desired rotary motion. In such an embodiment air or an inert gas may be employed as drive means, possibly in a heated state in order to increase the drying efficiency. One or more rotating vanes may also be used in the bottom portion in order to provide the desired movement for the material. Thus many modifications will be possible within the scope of the invention. In order to increase the efficiency a double screw may also be employed.

In the above description the invention is only illustrated by embodiments and is not limited to these. The inventive concept is therefore defined by the following patent claims.

What is claimed is:

1. A device for drying particulate, granular or powdered material, comprising a sealed drying chamber (1) which drying chamber (1) is of a circular shape and is equipped with a heating jacket (2) which envelops at least a part of side walls of the drying chamber and from which the drying chamber is sealed, the chamber (1) in a lower area having a material inlet (5) and in an upper area a material outlet (6) and comprising a movement device (3) for giving the material a rotating motion, wherein the drying chamber (1) is conically tapering over an entire or parts of a height thereof and is heated only the heating jacket (2).

2. A device according to claim 1, wherein the drying chamber (1) is conically tapering in the direction toward the lower portion of the drying chamber.

3. A device according to claim 1, wherein the drying chamber (1) is conically tapering in the direction towards an upper portion of the drying chamber.

4. A device according to claim 1, wherein the movement device (3) is a motor-driven screw, arranged substantially in the center area of the bottom of the drying chamber.

5. A device according to claim 1, wherein the drying chamber (1) is in the form of an underpressure tank with a suction air end piece (7) for air in the upper area of the drying chamber.

6. A device according to claim 1, wherein the top part (8) of the drying chamber is removable and attached to the main part by tightenable screws (10).

7. A device according to claim 6, wherein the top part (8) is depressed in a central area (9) and that a suction air end piece (7) is arranged in a top surface, near the side wall.

8. A device according to claim 1, wherein the movement device is at least a tangential and slanted nozzle for insertion of the material under pressure in an air or gas flow.

9. A device according to claim 1, wherein the movement device is composed of one or more slanted, rotating vanes.

10. A device according to claim 1, wherein there are provided setting elements for a speed of motion of the material and/or temperature for heating the side walls with control for said setting elements.

* * * * *